US005464121A

United States Patent [19]

Jones

[11] Patent Number: 5,464,121

[45] Date of Patent: Nov. 7, 1995

[54] PRECISION FLUID DISPERSING APPARATUS AND METHOD

[75] Inventor: Donald Jones, Sacramento, Calif.

[73] Assignee: Dade International Inc., Deerfield, Ill.

[21] Appl. No.: 402,412

[22] Filed: Mar. 10, 1995

Related U.S. Application Data

[63] Continuation of Ser. No. 89,131, Jul. 9, 1993, abandoned.

[51] Int. Cl.[6] ..... B65D 83/00

[52] U.S. Cl. ..... 222/1; 137/115; 222/397

[58] Field of Search ..... 222/1, 3, 394, 222/396, 397, 401; 239/76, 97; 137/115

[56] References Cited

U.S. PATENT DOCUMENTS

| | | | |
|---|---|---|---|
| 4,111,223 | 9/1978 | Gelnett | 137/115 |
| 4,291,612 | 9/1981 | Day | 137/115 X |
| 4,456,025 | 6/1984 | Childs | 137/115 |
| 4,482,509 | 11/1984 | Iannelli | 137/115 X |
| 4,537,648 | 8/1985 | Shiino et al. | 156/351 |
| 4,589,436 | 5/1986 | Schebler et al. | 137/115 |
| 4,836,241 | 6/1989 | Schoenwald | 137/115 X |
| 4,893,646 | 1/1990 | Wimmer | 137/115 X |
| 4,994,180 | 2/1991 | Sims et al. | 210/198.2 |
| 4,997,459 | 3/1991 | Pelkey | 137/115 X |

FOREIGN PATENT DOCUMENTS

| | | |
|---|---|---|
| 0351995 | 1/1990 | European Pat. Off. . |
| 0477811A3 | 4/1992 | European Pat. Off. . |
| 8115078 | 2/1983 | France . |
| 3531241A1 | 3/1987 | Germany . |
| 2046439 | 11/1980 | United Kingdom . |

OTHER PUBLICATIONS

R. L. Jolley et al., "Nonpulsing Reagent Metering for Continuous Colorimetric Detection Systems", *Analytical Biochemistry,* 28:300–306, 1969.

*Primary Examiner*—Kevin P. Shaver

*Attorney, Agent, or Firm*—Kurt A. MacLean; Poms, Smith, Lande & Rose

[57] ABSTRACT

A precision liquid reagent fluid dispensing apparatus (10) and method includes a continuously operating pump (16) inducting and pressurizing ambient air. The pressurized air is delivered at a first location into a flow-through volume (18) with provision to substantially completely abate at a second location any noncontinuous air flow or air pressure variations from the pump. A long-lived pressure sensor (32) which is substantially free of drift is associated with the flow through volume at a third location and provides a signal indicative of sensed air pressure. A controller (36) by reference to a calibration standard for the sensor provides a time-variant control signal in response to the sensed air pressure. At a forth location a duty cycle valve (38) vents pressurized air from the flow through volume in response to the control signal to provide at the second location a precisely regulated dispensing air pressure. The dispensing air pressure is applied via a reagent liquid container (46) and closure member (62) to a liquid reagent to pressurize this reagent for dispensing at a precise rate via a dispensing valve (82). The dispensing valve is sealingly carried by the closure member to reduce leakage paths and corrosion opportunities in the apparatus of the present invention.

20 Claims, 2 Drawing Sheets

μp
V
S
P
10
12
14
14
16
18
20
22
24
26
28
30
32
34
36
38
40
42
44
44
44
96
96
96
100
102
106
106
106
110
110
112
112
112
112

PRECISION FLUID DISPERSING APPARATUS AND METHOD

This is a continuation of application Ser. No. 08/089,131 filed on Jul. 9, 1993, now abandoned.

BACKGROUND OF THE INVENTION

1. Field of the Invention

The present invention relates generally to apparatus and methods for controllably dispensing a selected quantity of a fluid from a source thereof to a chosen receptacle therefor. More particularly, the present invention relates to a method, and to particular apparatus for practicing the method, to provide a medical diagnostic analyzer or incubator with a precision fluid dispensing system including a precisely regulated positive pressure source the positive pressure from which is applied to each of a plurality of source fluids which are held in respective closed containers for causing the source fluids to be discharged to the chosen receptacle under control of respective time duration modulated dispensing valves.

2. Discussion of the Related Technology

Analyzers and incubators which are used in the medical field for analysis of chemical and biological constituents of specimens, such as blood samples and other bodily fluids and tissues, require the addition of a variety of precisely-measured fluid reagents to the specimens and incubation cultures. Previously, these analyzers and incubators have included a variety of positive-displacement fluid pumps which directly metered the reagents to the specimens or incubation medium. These positive displacement metering pumps were complex and expensive, as well as requiring considerable maintenance. Sometimes, these pumps could be trouble-prone as well, resulting in shutdown of an analyzer or incubator with consequent loss of test results.

Another conventional fluid dispensing expedient which has been employed by some analyzers or incubators has been the use of a regulated air pressure source including an air pump and a spring-biased type of pressure regulator. The regulated air pressure from this source was supplied to reagent fluid which was held in a closed container, and discharge of the reagent was controlled by a normally-closed, time-duration-modulated dispensing valve. The quantity of reagent dispensed in such a system is a function of the applied pressure and the interval during which the dispensing valve is held open.

However, this conventional fluid dispensing system also is prone to a multitude of difficulties. Because the volume of the specimen or incubation containers, which are the receptacles for the reagents, is ordinarily very small (perhaps on the order of a few milliliters or smaller), precise metering of the reagents is necessary. As mentioned, with the time duration controlled dispensing valves, the quantity of reagent dispensed varies with the applied dispensing pressure. However, this pressure may vary from day to day and from moment to moment during operation of an analyzer or incubator.

For example, the spring-biased air pressure regulator may not be capable of precisely controlling the air pressure level which is applied to the reagent fluids over a period of time and under all operating conditions. That is, the spring bias of the air pressure regulator may decline as the regulator ages and the spring loses pre load. This gradual loss of dispensing air pressure level requires periodic recalibration of the air pressure regulator, with the quantity of dispensed reagents being progressively more uncertain with the passage of time after each calibration. Further, the pressure regulator may be temperature responsive so that the applied air pressure varies with changes in the ambient temperature. This temperature change sensitivity of the dispensing air pressure level can cause the quantity of reagents to vary from hour to hour within a single day.

Also, if there is a small air leak at one of the reagent containers, this reagent container, or all of the reagent containers, may not be provided with the required level of regulated air pressure so that dispensed quantities of this reagent or all of the reagents are short and test results are in doubt. In other words, the conventional spring-biased pressure regulator system may be sensitive to air flow volume so that the required level of air pressure is not provided under certain conditions of air flow. The inherent droop of a spring-biased air pressure regulator system with increasing air flow rate may even result in the air pressure applied to the reagents being less than required simply because of the rate at which reagents are dispensed from the system during a time of heavy demand for the reagents.

Still further, some of the reagents themselves are caustic, acidic or corrosive so that the environment in which the air pressure regulator is used is a difficult one in which to maintain a precise air pressure control with such conventional air pressure regulators. As may easily be appreciated in view of the discussion above describing the tenuous control over air pressure which is provided by a conventional regulator under good operating conditions, if the regulator is subjected to corrosion or other physical deterioration, the regulated pressure level certainly cannot be precisely maintained. All of these error sources tend to be additive so that conventional regulated air pressure fluid reagent dispensing systems have been somewhat troublesome and lacking in reliability.

SUMMARY OF THE INVENTION

In view of the above, an object of this invention is to provide a precision fluid dispensing apparatus with a regulated pressure source for a medical analyzer or incubator which does not employ a conventional spring-biased air pressure regulator.

An additional object for this invention is to provide a fluid dispensing apparatus with such a regulated air pressure source which is not affected adversely by the described use environment.

Further, an object of this invention is to provide such a fluid dispensing apparatus with a regulated air pressure source which is not sensitive to the fluid flows which occur in ordinary use, and to a certain extent is not sensitive to abnormal air flow rates as may result from a small air pressure leak at one or more of the reagent holding containers, so that the regulated air pressure does not vary as a consequence of these fluid flows.

Still further, an object of the present invention is to provide such a fluid dispensing apparatus with an improved fluid holding container which also includes provision for disposing the discharge metering valve immediately at this container, and to reduce the leakage flow paths of the apparatus, as well as reducing the number fittings and opportunities for corrosion and deterioration in the apparatus as a whole.

In view of the above, the present invention provides a precision fluid dispensing apparatus in which a continuously-operating positive pressure pump provides pressurized air to a flow-through volume, a gauge pressure sensor provides a first signal indicative of air pressure in the flow-through volume, a duty-cycle valve vents pressurized air from the flow-through volume in response to a control signal, and a controller by reference to a calibration standard and in response to the first signal provides the control signal to the duty-cycle valve to precisely regulate air pressure in the flow-through volume.

Further, the present invention provides such a fluid dispensing apparatus in which a source fluid to be dispensed is disposed in a holding container, the holding container includes a vessel with an opening and a closure member, a dispensing valve is removably carried by the closure member which also defines a port communication with the flow-through volume for receiving therefrom and into the vessel pressurized air of regulated pressure, and a pickup tube is carried by the dispensing valve and extends downwardly through a passage of the closure member into the source fluid for flowing source fluid outwardly of the vessel when the dispensing valve is open.

According to a preferred embodiment of the invention, the vessel used to hold the source fluid is a glass bottle which also serves as a shipping container for the source fluid. The closure member attaches to the bottle at a threaded neck thereof to replace the bottle cap. This closure member includes a fitting upon which the dispensing valve sealingly attaches, and the closure member also includes a resilient bail member for embracing the dispensing valve to removably retain this valve in sealing relation with the closure member.

An advantage of the present invention resides in the precise and consistent level of regulated air pressure which is supplied to the source fluid containers. Because this regulated pressure is not dependent upon a spring pressure to set and maintain its level, the pressure does not vary with the passage of time or with changes in temperature. The pressure sensor which is used to sense this regulated pressure may be a very long-lived device which is substantially free of calibration drift. Further, calibration compensation factors, such as for temperature, sensor aging, and pressure range compensation may be incorporated into the pressure controller. For example, a quartz pressure transducer of the capacitive or piezoelectric type may be used to sense the regulated air pressure. Because the pressure sensor is itself virtually free of calibration drift, the controller can be provided with a calibration standard which is used to provide the control signal to the duty-cycle valve. Because the regulated air pressure is dynamically sensed and regulated in the flow-through volume by the pressure sensor, controller, and duty-cycle valve, this pressure is not sensitive to air flow rates normally encountered in operation of a chemical analyzer or incubator. Further, even a certain range of abnormal air flow rated, such as might result from loosening of a closure member on a source fluid bottle, can be tolerated with out droop in the level of the regulated air pressure. Consequently, the present invention provides a fluid reagent dispensing system which is much more precise and fault tolerant than any prior dispensing system.

These and additional objects and advantages of the present invention will be apparent from a reading of the following detailed description of a single exemplary preferred embodiment of the invention taken in conjunction with the following drawing Figures.

DESCRIPTION OF THE DRAWING FIGURES

FIG. 1 provides a schematic view of a fluid dispensing apparatus embodying the present invention; and FIG. 2 presents an enlarged and partially cross sectional view of a portion of FIG. 1, and showing a source fluid container with closure member and fluid dispensing valve.

DETAILED DESCRIPTION OF THE PREFERRED EMBODIMENT

Figure 1:
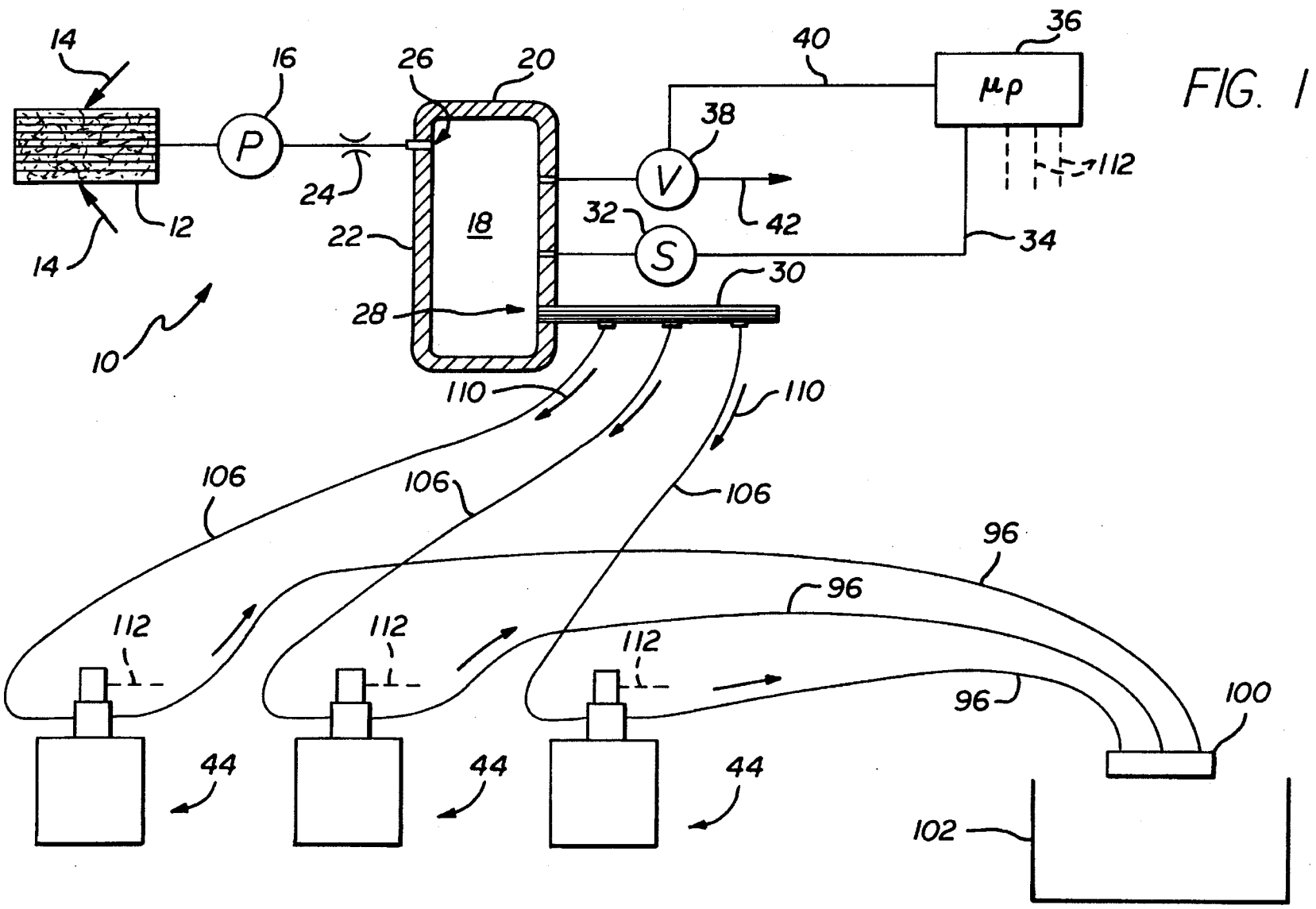

Viewing FIG. 1, a fluid dispensing apparatus 10 is depicted. The fluid dispensing apparatus 10 includes an air filter 12 into which flows ambient air, as is indicated by the arrows 14. A continuously-operating pump 16 inducts the filtered ambient air 14 via the air filter 12, and delivers this air pressurized to a flow-through volume 18. The flow-through volume 18 is defined by a pressure vessel 20 having a boundary wall 22. Because the fluid dispensing apparatus 10 is intended to operate at a comparatively low, but precisely controlled, air pressure level the pressure vessel 20 may be made with wall 22 of comparatively thin metal, of plastic, or of wound filament construction, for example. However, the present invention is not limited to operation at low pressures, so that the pressure vessel 20 may be a heavy-duty, vessel capable of containing pressures of several hundred pounds per square inch, or higher.

Importantly, the pressure vessel 20 has a volume 18 chosen on the one hand in view of the character of pump 16 to damp substantially completely any pressure flux which results from pulsations of output air flow from this pump. For example, the pump 16 may be a turbine type with substantially constant output air flow, in which case the volume of pressure vessel 20 can be comparatively small. On the other hand, if the pump 16 is configured as a vane type of air pump with some limited noncontinuous and pulsating output air flow a volume 18 of greater size will be required. Still further, if the pump 16 is configured as a single-chamber piston or diaphragm pump with clearly noncontinuous and pulsating air flow, this pump may require a much larger volume 18 for pressure vessel 20. In connection with this latter possibility, a flow smoothing orifice 24 is schematically shown in connection with the air flow communication from pump 16 into volume 18. The pump 16 has an air in flow connection into the volume 18 as is indicated at 26.

By selection of the volume of pressure vessel 20 and the size of orifice 24 (if needed) in view of the nature of pump 16, the volume 18 will substantially completely damp the pressure flux and will maintain a constant pressure level therein during air flow therethrough, as will be seen.

On the other hand, the volume 18 of pressure vessel 20 is also chosen to be at least a certain volume in view of the anticipated normal, and also a certain degree of abnormal, air flow volume demands of the fluid dispensing apparatus 10. That is, the volume 18 serves as a pressure flux buffer or isolator both with respect to the variations (if any) of the rate of air inflow from pump 16, and the air outflow variations to the remainder of apparatus 10, as will be described. The objective of choosing a particular volume 18 for pressure vessel 20 is to damp out the effects of these noncontinuous air flows and to allow the maintenance in the volume 18 of a precisely regulated air pressure.

Connecting to the flow-through volume 18 at a location 28 sufficiently remote from the inflow connection 26 from pump 16 is an air outflow conduit 30 supplying precisely regulated pressurized air to the remainder of dispensing apparatus 10. As will be explained, the pressure level of the air flowing in outflow conduit 30 can be regulated with unprecedented precision, free of pressure drifts with time, temperature, or droop with air flow volume within a certain range of normal and abnormal operating flow rates.

In order to provide means for precisely regulating the air pressure level in through-flow volume 18, a precise gauge pressure sensor 32 is connected to this volume also sufficiently remote from the inflow connection 26 as to be free of pulsating and noncontinuous pressure effects from pump 16. Preferably, the sensor 32 is connected to volume 18 proximate to the connection 28 of conduit 30. The pressure sensor 32 provides a signal indicative of local gauge pressure in the volume 18. This signal from sensor 32 is provided via a line 34 to a controller 36. Preferably, the controller 36 is a microprocessor-based device capable of receiving the signal from sensor 32 along with a calibration standard for this sensor which may include a correction factor for temperature or sensor ageing, for example, and producing a control signal in response thereto.

The control signal of controller 36 is provided to a duty-cycle valve 38 via a line 40. By duty-cycle is meant that the valve 38 is a solenoid-operated normally-open valve with a quick opening and closing rate. The control signal from controller 36 is in the form of a square wave of variable duration which is repeated several times per second. In fact, the duty cycle valve 38 may be cycled opened and closed several hundred or more times per second. This square wave signal may have a duration from substantially zero to substantially continuously on. The duty cycle valve 38 closes in response to each square wave, and remains closed for the duration of the square wave control signal.

This type of control is commonly referred to a pulse duration modulation (PDM). When the duty cycle valve 38 is open, it vents pressurized air from volume 18 of pressure vessel 20, as is indicated by arrow 42. Thus, with the frequency of the control signal from controller 36 set at a selected level, the time proportion during which valve 38 is open can easily be controlled between continuously closed and substantially continuously open by variation of the PDM control signal.

When the duty cycle valve 38 is closed, pressurized air inflow from pump 16 increases the air pressure in volume 18. Conversely, when this duty-cycle valve is open, it vents pressurized air from the volume 18 to decrease the air pressure therein. The duty cycle valve 38 is sized so that if it is continuously open, the pump 16 can maintain only a fraction of the desired regulated air pressure level in volume 18. Thus, the level of air pressure in volume 18 is very responsive to the duty cycle valve 38, and dynamic control over this pressure may be effected by controller 36.

Preferably, the regulated air pressure level maintained in the flow-through volume 18 is only 3 psig. This low air pressure is sufficient to allow precise and controllable dispensing of the reagent fluids in the analyzers and incubators which are intended to be served by the present fluid dispensing apparatus. This low positive pressure dispensing of reagent fluids makes possible, among other things, the use of small low pressure and drip-resistant dispensing valves, as well as small diameter, low- pressure tubing to convey the reagents to the receptacles therefor. All of these factors have an advantageous effect in the packaging and lay out of the analyzers and incubator machines themselves.

However, this low air pressure and the effect that variations of this pressure level has on the quantity of dispensed reagents makes it easy to understand why an unprecedented level of precision in regulation of this air pressure level is necessary. As was pointed out above, the reliability of test results impacting human health is influenced by the accuracy of the fluid dispensing apparatus of the present invention.

Figure 2:
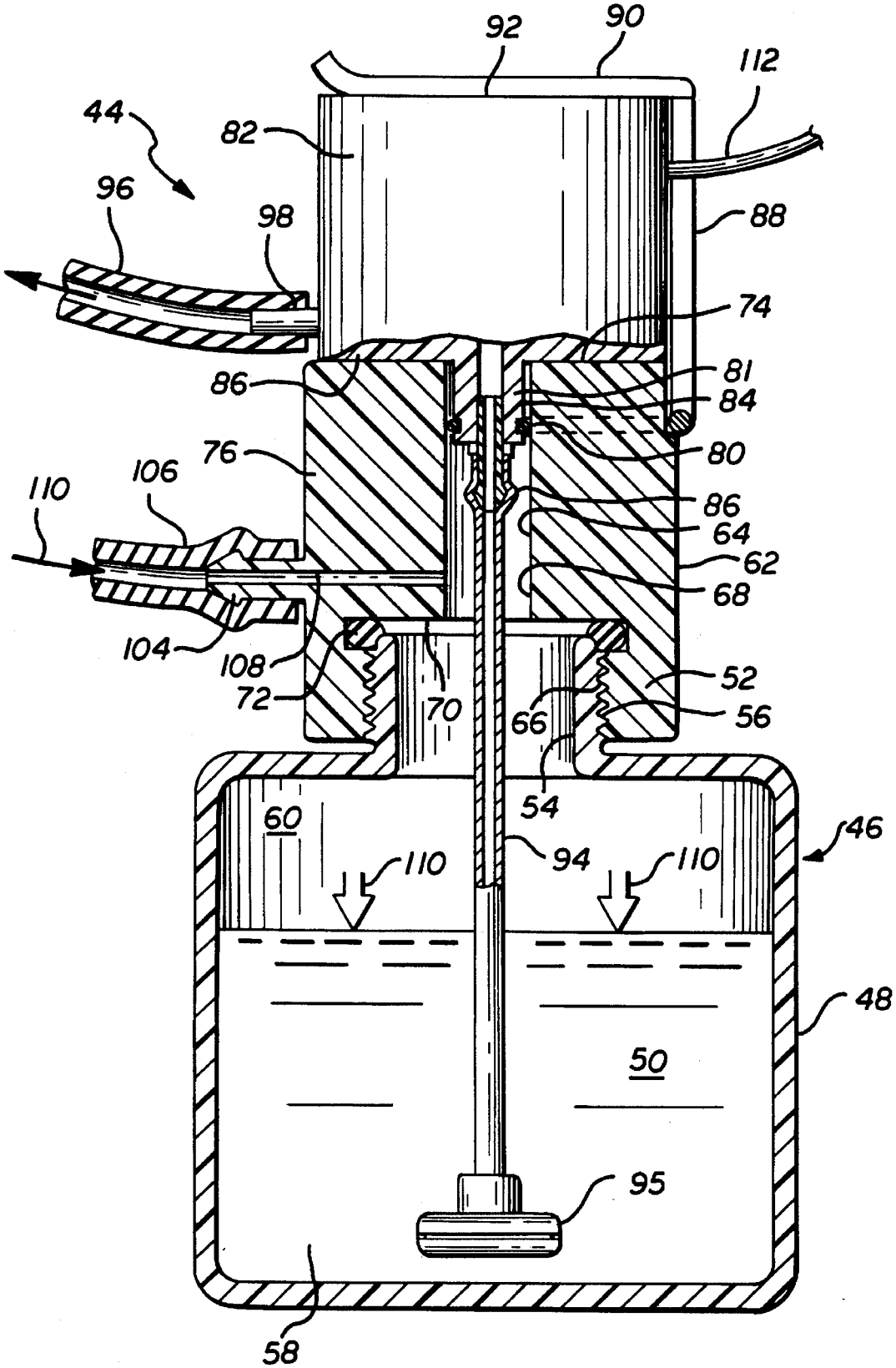

Having observed the apparatus and its operation for providing a precisely regulated dispensing air pressure level, attention may now be turned to another aspect of the precision fluid dispensing apparatus of the present invention, viewing FIGS. 1 and 2 in conjunction. As was stated earlier, the precisely regulated air pressure from volume 18 is provided via conduit 30 to plural fluid dispensing units, each referenced with the numeral 44. Generally, these fluid dispensing units 44 each include a closed fluid container, referenced with the numeral 46 and including a wall 48 defining a chamber 50 and an upwardly extending neck 52 with opening 54. The neck 52 outwardly defines screw threads 56. Above the screw threads 56, the neck 52 includes an outstanding extending cylindrical portion **52*a* extending a short distance above the top of the threads 56. Within the chamber 50 is disposed a quantity of a liquid reagent fluid 58, and an ullage volume 60**.

Threadably engaged with the container 46 at neck 52 thereof is a closure member referenced with the numeral 62. This closure member is generally cylindrical and is preferably round in plan view. The closure member 62 defines a stepped through bore 64, which at a lower, larger diameter bore portion 66, defines screw threads for threadably receiving the neck 52. An adjacent smaller diameter bore portion 68 cooperates with the bore portion 66 to define a shoulder 70 on the bore 64. An O-ring type of sealing member 72 is received into the bore portion 66 against the shoulder 70 and sealingly cooperates with the neck 52 of the container 46 to provide a secure and leak-resistant connection between the container and closure member. In order to provide secure threaded attachment of the container 46 to the closure member 62 with only hand tightening, the O-ring sealing member 72 is sized to frictionally accept the cylindrical neck portion **52*a*. That is, the O-ring 72 performs a dual function of forming a seal between the container 46 and closure member 72, and also of frictionally interengaging with these two parts to keep them threadably engaged together. Of course, when it is desired to remove the container 46 from closure member 62, hand loosening of the container is sufficient to effect its removal. Also importantly, the bore portion 66 is of sufficient depth that substantially the entire extent of the screw threads 56 on neck 52 are threadably engaged by the threads of the closure member 62. This advantageous cooperation of the closure member 62 with the container 46 has been found to be important in resisting loosening of the closure members on the containers and with resultant loss of pressurized air from the dispensing apparatus. As was explained earlier, the present apparatus is able to tolerate a degree of air pressure leakage while still maintaining a precise dispensing air pressure supply to plural dispensing units. However, avoidance of pressurized air leakage at the containers 46** is an important aspect of the present invention.

At its upper end 74, the closure member defines an upright cylindrical boss 76 upon which the portion 68 of through bore 64 opens to define an opening at 78. Within the bore portion 68 an O-ring type of sealing member 80 is carried on a stem 81 of an solenoid-operated dispensing valve 82. That is, the stem 81 defines a circumferential groove 84 which receives the O-ring 80. A small hose barb 86 depends from the stem 81 and projects toward the chamber 50.

Closure member 62 pivotally carries a resilient formed-wire bail member 88 (which is partially illustrated with dashed lines viewing FIG. 2) which extends upwardly around the dispensing valve 82 and includes an engagement portion 90 lying horizontally across the top surface 92 of the dispensing valve. This bail member urges the dispensing valve 82 into sealing engagement with the O-ring seal 72, but allows rapid removal and replacement of the dispensing valve on closure member 62 without the need for tools to be used.

In order to access the liquid reagent fluid 58, the dispensing valve 82 includes a depending pick up tube 94 received on the hose barb. This tube 94 extends downwardly through the bore 64 with clearance and ends close to but short of the bottom of the fluid 58. At its lower end, the pick up tube 94 carries a strainer 95 which includes a disk of mesh material (not shown) through which liquid from the chamber 50 flows into the tube 94. This strainer 95 is effective to exclude large particulates from the dispensing valve 82. From each of the fluid dispensing units 44, a flexible fluid dispensing conduit 96 extends from a hose barb 98 in fluid flow communication with the pick up tube 94 when the valve is open to a fluid dispensing head 100. This fluid dispensing head 100 is suspended over the fluid receiving receptacle 102, which as mentioned above, is one of the chemical analysis cells or incubation chambers of the associated analyzer or incubator.

A hose barb 104 extending outwardly on the closure member 62 receives a hose 106 communicating the precisely regulated dispensing air pressure to the container 46 via a passage 108 opening from this hose barb into the bore portion 68. Thus, this regulated dispensing air pressure is communicated from the volume 18 of pressure vessel 20 into the ullage volume 60 of each of the dispensing units 44, as is indicated by the arrows 110.

Each of the dispensing valves 82 has electrical connection with the controller 36, as is indicated by dashed lines 112. To dispense a desired quantity of any one or more of the liquid reagent fluids from the dispensing units 44 to the receptacle 102, the controller commands the respective dispensing valve 82 to open and remain open for a precisely timed interval. Because the present invention precisely maintains a regulated dispensing air pressure in each of the dispensing units 44, the quantity of dispensed reagent will be directly proportionate with the open duration of the dispensing valve 82.

While the present invention has been depicted and described and is defined by reference to a particularly preferred exemplary embodiment of the invention, such reference does not imply a limitation on the invention, and no such limitation is to be inferred. The invention is subject to considerable modification, alteration, and supplementation, as will occur to those ordinarily skilled in the pertinent arts. For example, the flow through volume 18 could be divided into two or more sub-volumes connected by flow smoothing orifices. This division of the volume 18 can be accomplished by providing plural pressure vessels which communicate with one another, or more preferably, by providing a series of internal walls and baffles in the pressure vessel 20 to control air flow therethrough. The duty cycle valve then would communicate with a selected one of these sub-volumes such that the out flow connection to conduit 30 was effectively isolated from all air flow discontinuities from the pump 16, duty cycle valve 38, and also from the air flow variations resulting from operation of the dispensing valves 82 themselves. Also, the outflow 42 from duty cycle valve 38 could be provided still partially pressurized to the inlet of pump 16 both to decrease the driving power required for this pump, as well as to reduce the volume of air which must be filtered by filter 12. Also, the controller 36 may be configured as a microprocessor based unit as described, or more preferably may include a microcomputer or personal computer which is programmed to control both the duty cycle valve 38 and the fluid dispensing valves 82.

I claim:

1. A precision fluid dispensing apparatus comprising:

a substantially continuously-operating positive pressure pump providing pressurized air;

a flow-through volume receiving said pressurized air;

a gauge pressure sensor providing a first signal indicative of air pressure in said flow-through volume;

a duty-cycle valve venting pressurized air from said flow-through volume in response to a control signal;

and a controller by reference to a calibration standard and in response to said first signal providing said control signal to said duty-cycle valve to provide a precisely regulated air pressure said the flow-through volume.

2. The precision fluid dispensing apparatus of claim 1 wherein said pump communicates with said flow-through volume at a first location, said precisely regulated air pressure communicating from said flow-through volume at a second location spaced from said first location, and said gauge pressure sensor communicating with said flow-through volume adjacent said second location.

3. The precision fluid dispensing apparatus of claim 1 further including means for communicating said regulated air pressure to a source fluid which is to be dispensed to pressurize said source fluid, a normally closed dispensing valve in fluid communication with said pressurized source fluid, and said dispensing valve when open communicating said source fluid to a receptacle therefore at ambient pressure, whereby with precise regulation of said air pressure level and pressurization of said source fluid the latter is dispensed at a volume directly proportionate with the interval during which said dispensing valve is open.

4. The precision fluid dispensing apparatus of claim 3 further including a source fluid container having a chamber with an opening and a closure member closing said opening and carrying said dispensing valve in close proximity to said source fluid.

5. The precision fluid dispensing apparatus of claim 4 wherein said closure member includes a body carrying said dispensing valve, and said body both communicating said regulated air pressure into said chamber and sealingly cooperating with said container to provide substantially leak-free retention of said precisely regulated air pressure in said chamber to pressurize said source fluid therein.

6. The precision fluid dispensing apparatus of claim 5 wherein said fluid dispensing valve includes a pick up tube extending through said body and into said source fluid.

7. The precision fluid dispensing apparatus of claim 6 wherein said body includes a through bore through which said pick up tube extends, and said body further including passage means communicating said precisely regulated air pressure to said through bore.

8. The precision fluid dispensing apparatus of claim 7 wherein said container includes a bottle with a threaded neck portion, said body through bore including an enlarged diameter portion threadably receiving said threaded neck portion of said bottle to sealingly close one end of said through bore, and said dispensing valve sealingly closing an opposite end of said through bore.

9. The precision fluid dispensing apparatus of claim 8 wherein said closure member further includes resilient means for removably retaining said dispensing valve in sealing engagement with said closure member at said other end of said through bore.

10. The precision fluid dispensing apparatus of claim 9 wherein said resilient means for removably retaining said dispensing valve includes said closure member pivotally carrying a formed wire bail member in a first position embracing said dispensing valve in sealing cooperation with said closure member.

11. The precision fluid dispensing apparatus of claim 8 wherein said closure member defines a boss at said other end of said through bore, said dispensing valve setting upon said boss and sealingly cooperating therewith.

12. The precision fluid dispensing apparatus of claim 11 wherein said dispensing valve further defines a recess receiving said boss.

13. A method of precision fluid dispensing, said method including the steps of continuously pressurizing ambient air, flowing said pressurized air through a flow-through volume, utilizing said flow-through volume to abate any noncontinuous air flows and pressure flux of said continuously flowing pressurized air, sensing the pressure level of said pressurized air in said flow-through volume, producing a signal in response to said sensed air pressure level, using a controller to produce a venting control signal in response to said sensed air pressure signal and by reference to a calibration standard, using a duty cycle valve to vent pressurized air to ambient in response to said venting control signal to provide a precisely regulated dispensing air pressure level, and pressurizing fluid to be dispensed with said precisely regulated dispensing air pressure to dispense said fluid to ambient at a controlled rate.

14. The method of claim 13 further including the steps of communicating said pressurized air into said flow-through volume at a first location, and at a second location spaced from said first location flowing pressurized air from said flow-through volume to said fluid to be dispensed.

15. The method of claim 14 further including the steps of sensing said pressurized air pressure level at a third location intermediate said first and said second locations, and venting pressurized air from said flow-through volume via said duty cycle valve at a forth location also intermediate said first and second locations.

16. The method of claim 15 further including the step of disposing said forth location upstream of said third location with respect to flow of pressurized air through said flow-through volume from said first location to said second location.

17. A precision liquid reagent fluid dispensing apparatus comprising:

a continuously operating pump inducting and pressurizing ambient air, said pump delivering said pressurized air to a flow-through volume at a first location thereof;

said flow-through volume including a selected volume effective at a second location spaced from said first location to substantially abate flow instabilities and variations of pressure of said pressurized air received at said first location;

a pressure sensor at a third location of said flow-through volume sensing a pressure level of said pressurized air and providing a pressure signal in response thereto;

a controller providing a time-variant control signal in response to said pressure signal and by reference to a calibration standard for said sensor;

a duty cycle valve receiving said time-variant control signal and venting pressurized air at a forth location of said flow-through volume in response thereto to provide at said second location of said flow-through volume a precisely regulated dispensing air pressure level; and means for applying said dispensing air pressure level to a liquid reagent fluid which is to be dispensed, thereby to pressurize said fluid to said precisely regulated level of said dispensing air pressure.

18. The precision fluid dispensing apparatus of claim 17 wherein said means for applying said dispensing air pressure to a liquid reagent fluid includes a chambered fluid container having a neck opening into said chamber and being provided with an external thread, a closure member defining a through bore and including at one end thereof an enlarged diameter bore portion threadably engageable on said neck and sealingly cooperating with said container to close said chamber, at an opposite end said closure member defining an upright boss upon which said through bore opens, a dispensing valve sealingly received on said boss, said dispensing valve including a liquid pickup tube depending into said liquid reagent in said chamber and an outlet port to which said pickup tube communicates said reagent liquid when said valve is open, said closure member further defining a dispensing air pressure inlet port communicating with said chamber and with said second location of said flow-through volume.

19. The precision liquid reagent fluid dispensing apparatus of claim 18 wherein said time-variant venting control signal is a pulse width modulated signal.

20. The precision liquid reagent fluid dispensing apparatus of claim 18 wherein said larger diameter bore portion substantially completely threadably receives said threaded container neck to sealingly engage therewith.

* * * * *